United States Patent [19]

Voll et al.

[11] Patent Number: 4,709,584

[45] Date of Patent: Dec. 1, 1987

[54] DEVICE FOR TAKING SAMPLES OF BOTTOM SEDIMENTS FROM WATER BASINS

[75] Inventors: Martin A. Voll; Robert K. Eiskop; Kharri I. Yankovsky, all of Tallin, U.S.S.R.

[73] Assignee: Institut Khimii AN, Tallin, U.S.S.R.

[21] Appl. No.: 918,929

[22] Filed: Oct. 15, 1986

[51] Int. Cl.[4] ..... G01N 1/04

[52] U.S. Cl. ..... 73/864.44

[58] Field of Search ..... 73/864.51, 864.61, 864.63, 73/864.64, 864.65, 864.41, 864.44, 864.45, 864.42, 864.43, 864.31, 864; 175/58, 59

[56] References Cited

U.S. PATENT DOCUMENTS

| | | | |
|---|---|---|---|
| 3,295,616 | 1/1967 | Charlton et al. | 175/58 |
| 3,372,760 | 3/1968 | Raymond et al. | 73/864.44 |

FOREIGN PATENT DOCUMENTS

| | | | |
|---|---|---|---|
| 0006719 | 3/1965 | Japan | 73/864.44 |
| 623128 | 9/1978 | U.S.S.R. . | |
| 00815564 | 3/1981 | U.S.S.R. | 73/864.45 |
| 0842453 | 6/1981 | U.S.S.R. | 73/864.65 |
| 1013810 | 4/1983 | U.S.S.R. | 73/864.91 |
| 1111053 | 8/1984 | U.S.S.R. | 73/864.45 |

*Primary Examiner*—Stewart J. Levy
*Assistant Examiner*—Robert R. Raevis
*Attorney, Agent, or Firm*—Fleit, Jacobson, Cohn & Price

[57] ABSTRACT

A device for taking samples of bottom sediments from water basins, comprises a vertical sectional coring tube, a ballast weight, rod-type vertical supports and shock-absorbing units. The latter are made in the form of hollow cylinders with closed ends, with a plunger in each cylinder and installed in parallel with the coring tube from the outside. A hole is made in the upper and lower ends of each cylinder, and passed through the holes in the lower ends are the rod-type supports each of which is rigidly connected by one end with a respective plunger.

4 Claims, 3 Drawing Figures

DEVICE FOR TAKING SAMPLES OF BOTTOM SEDIMENTS FROM WATER BASINS

FIELD OF THE INVENTION

The invention relates to the oceanographic instruments for investigating properties of substances and, more particularly, to devices for taking samples of bottom sediments from water basins.

BACKGROUND OF THE INVENTION

Known in the prior art is a device for taking samples of bottom sediments from water basins, comprising a vertical coring tube with a closed upper end provided with a check valve, a ballast weight in the lower portion of the coring tube around the outside walls thereof (cf. USSR Inventor's Certificate No. 623,128, class G01N, 1/04, published in 1978).

When this device is free-falling on the load rope to the bottom of a water basin by gravity, the integrity of a surface layer of the bottom sediments is disturbed which impairs the quality of a taken sample. In addition, the sample cannot be extracted from the coring tube of the given device in the form of thin layers.

Also known to the prior art is a device for taking samples of bottom sediments from water basins, comprising a vertical sectional tube with a closed upper end provided with a check valve, a ballast weight on the outside surface of the closed upper end having removable ballast disks, and rod-type vertical supports externally arranged on the sides of the coring tube (cf.USSR Inventor's Certificate No. 1,013,810, class G01N, 1/10, published in 1983).

This device makes it possible to remove the taken sample in thin layers by way of a successive detachment of the coring tube sections. The presence of the rod-type vertical supports prevents tipping of the coring tube when it interacts with the soil and the removable disks of the ballast weight make it possible to partially regulate the speed of the device sinking. However the known device fails to provide, especially under adverse weather conditions, a smooth contact of the coring tube with the bottom of a water basin and an approach of the device to the bottom at a minimum speed (less than 25 cm/s) insuring reliability of the sample taken without disturbing the layers of the initial structure of bottom sediments.

The invention seeks to improve the design of a device for taking samples of bottom sediments from water basins so that it will have a means for insuring a smooth contact of the device with the bottom of a water basin without disturbing the integrity of a surface layer of the bottom sediments even under adverse weather conditions.

SUMMARY OF THE INVENTION

It is an object of the invention to improve the representativeness of taken samples.

It is another object of the invention to improve the representativeness of samples under adverse weather conditions.

The nature of the invention consists in that a device for taking samples of bottom sediments from water basins, comprising a vertical sectional coring tube with a closed upper end provided with a check valve, a ballast weight on the closed upper end and rod-type vertical supports, according to the invention is provided with shock-absorbing units corresponding in quantity to the number of the rod-type supports and made in the form of hollow cylinders with closed ends, with a plunger in each cylinder, and externally installed on the coring tube in parallel therewith, and secured by their lower ends at the upper end of the coring tube, a hole being made in the upper and lower ends of each cylinder and passed through the holes in the lower ends of the cylinders are the rod-type supports, each of which is rigidly connected by one end with a respective plunger and has a length exceeding the length of the coring tube.

Conical attachments with the vertices of cones facing free ends of the rod-type supports may suitably be installed on the free ends of the rod-type supports below the open end of the coring tube.

It is desirable that the ratio of the diameter of the holes in the upper ends of cylinders to the bore of the cylinders be selected with 1:10 to 1:3.

A device for taking samples of bottom sediments from water basins embodied according to the present invention makes it possible to take the samples of bottom sediments in the form of separate layers of the initial unchanged structure; under adverse weather conditions, irrespective of the speed of the device sinking to the bottom of a water basin, a smooth contact of the coring tube with the bottom is insured without disturbing the integrity of the surface layer of bottom sediments.

BRIEF DESCRIPTION OF DRAWINGS

The invention will now be described in greater detail with reference to a specific embodiment thereof, taken in conjunction with the accompanying drawings, wherein.

DETAILED DESCRIPTION OF THE INVENTION

Figure 1:
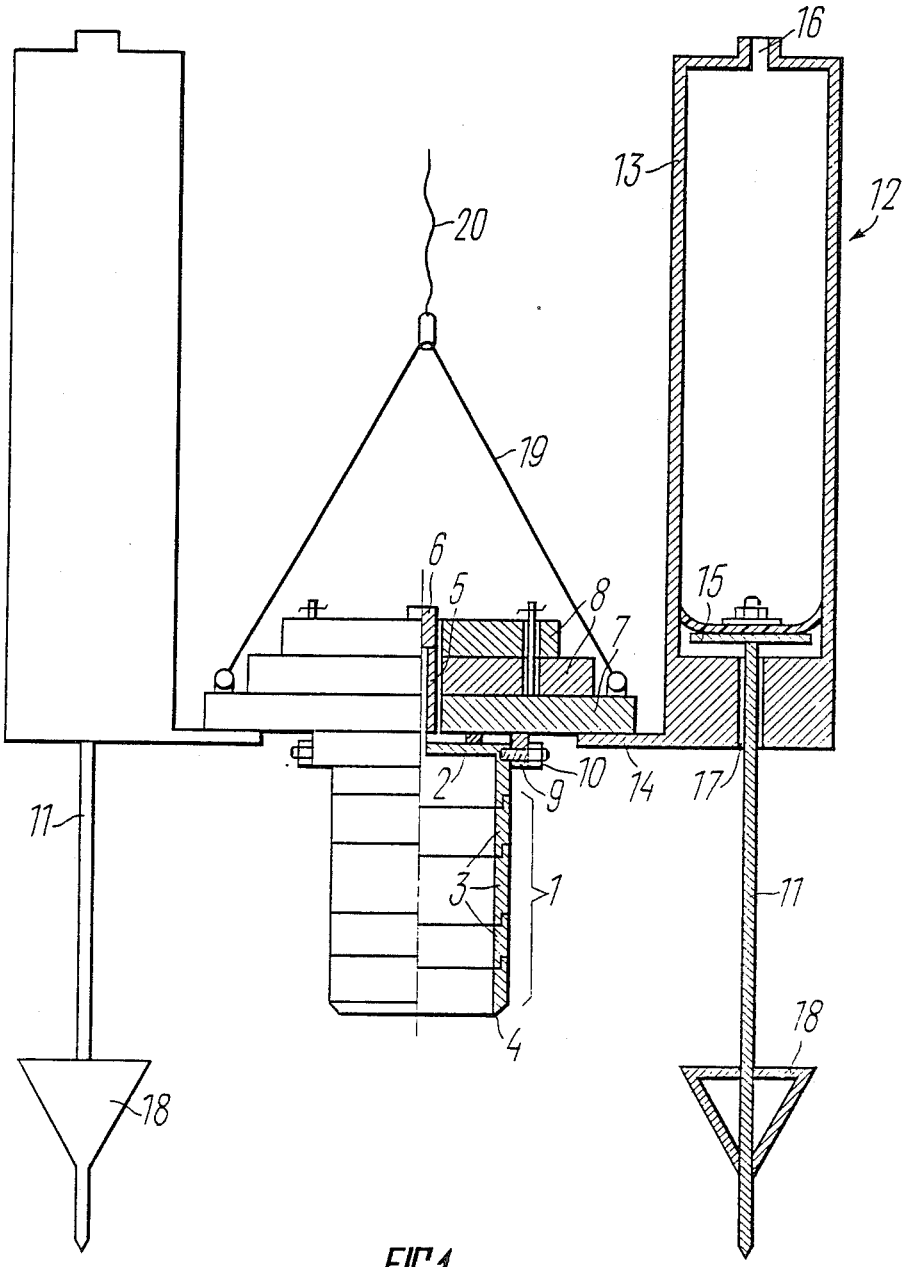
FIG. 1 is a general view partially in section illustrating the device for taking samples of bottom sediments from water basins.

A device for taking samples of bottom sediments from water basins illustrated in FIG. 1, comprises a vertical coring tube 1 with a closed upper end 2, divided into sections 3. A lower open end of the coring tube 1 has a sharpened edge 4. A check valve 6 is mounted in the uper end 2 of the coring tube 1 through the medium of a connection 5. A main ballast weight 7 and removable ballast disks 8 are disposed on the external surface of the upper end 2. The coring tube 1 is connected with the ballast weight 7 through the medium of a ring 9 and bolts 10. The device also comprises three or more vertical rod-type supports 11 equally spaced along the circumference of the coring tube 1 from the outside and having a length exceeding the length of the coring tube 1, and shock-absorbing units 12 corresponding in quantity to the number of the rod-type supports 11. The shock-absorbing units 12 are made in the form of hollow cylinders 13 with closed ends and secured in parallel with the coring tube 1 from the outside on carrying elements 14 so that the lower ends of the cylinders 13 are level with the upper closed end 2 of the coring tube 1. Each cylinder 13 has a plunger 15 and also a center hole 16 in the upper end and a center hole 17 in the lower end. Passed through the holes 17 are the rod-type supports 11, each of which is rigidly associated by one end with the respective plunger 15. Conical attachments 18 with the vertices of cones facing free ends of the rod-type supports 11 are installed on the free ends of the rod-type supports 11 below the level of an open end of the coring tube 1 (in position when the plungers 15 are at the lower ends of the cylinders 13).

The ratio of the diameter of the holes 16 to the bore of the cylinders 13 is selected from 1:10 to 1:3.

By means of rods 19 (3–4 pieces) pivotally secured by the ends thereof to the ballast weight 7, the device is suspended from a wire rope 20, for example, of a winch mechanism (not shown in drawings).

The device for taking samples of bottom sediments from water basins, according to the present invention, operates in the following way.

Figure 2:
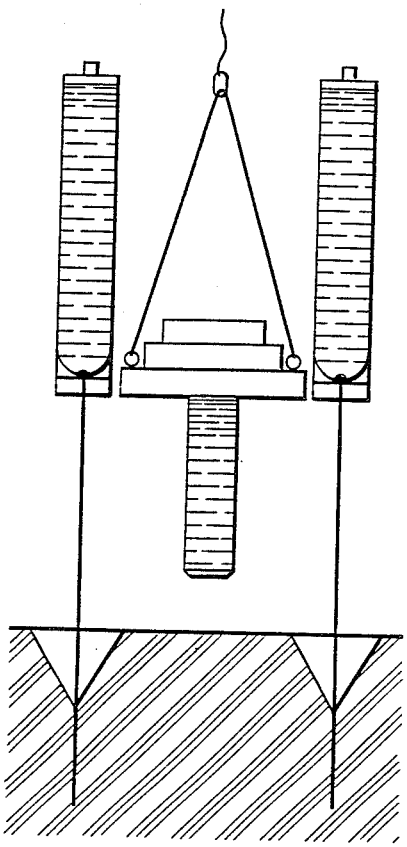
FIG. 2 diagrammatically illustrates the same of FIG. 1 at the moment the supports come in contact with the surface layer of bottom sediments.
Figure 3:
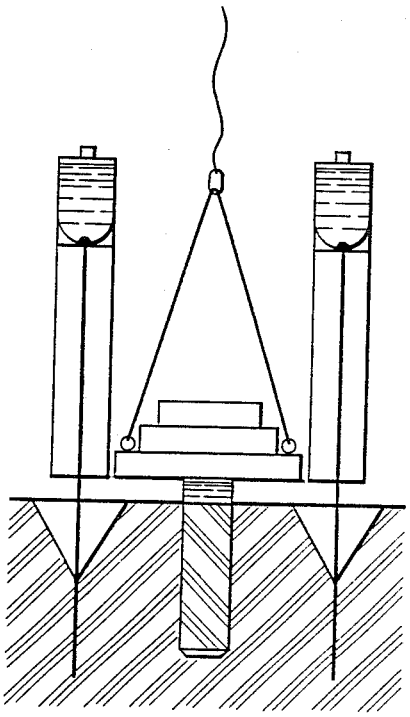
FIG. 3 illustrates the same of FIG. 2 at the moment of sampling.
Figure 2:
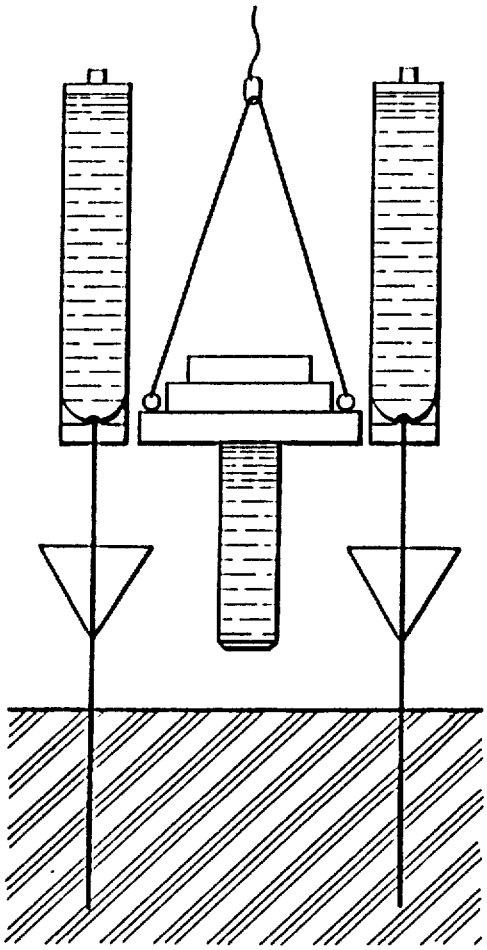

For taking a sample of bottom sediments the device suspended from the wire rope 20 is sunk to the bottom of a water basin. The rod-type supports 11 are the first to touch the bottom sediments (FIG. 2 illustrates the device in this position). When the attachments 18 sink in the bottom sediment their conical shape provides smooth braking of the device and reduction in the sinking speed thereof to a minimum. Due to a selected length of the supports 11, the edge 4 of the coring tube 1 is not yet in touch with the bottom sediments at this moment. Further sinking of the device is accomplished by gravity and is governed by functioning of the shock-absorbing units 12. With the device slowly sinking, the plungers 15 in the cylinders 13 start to move upwards, thereby forcing out the water contained in the cylinders 13 through the holes 16. When the edge 4 of the coring tube 1 comes in contact with the surface of the bottom sediments the bottom soil starts slowly filling the coring tube 1 without disturbing the integrity of layers of the bottom sediments. The position of the device at the moment when the sample of bottom sediments is filling the coring tube 1 is illustrated in FIG. 3. The speed of sinking of the device with the coring tube 1 depends upon the ratio between the bore of the cylinders 13 of the shock-absorbing units 12 and the diameter of the holes 16 for discharge of water from the cylinders 13.

The greater the ratio between the diameter of the discharge holes 16 and the bore of the cylinders 13, the more speedy will be the sinking of the device with the coring tube 1 in the bottom sediment, and vice versa.

If samples of bottom sediments are easy to be taken, it is expedient to use the ratio between the diameter of the discharge holes 16 and the bore of the cylinders 13 of the shock-absorbing units 12 in a range of 1:10 and if bottom sediments are more dense, it is advisable to use the ratio of 1:3. The rod-type supports 11 serve at the same time to prevent the device from tipping in the process of sampling.

After the coring tube 1 is filled with the bottom soil the device is lifted by means of the wire rope 20. At lifting the check valve 6 closes and at the expense of a negative pressure created when the soil sample tends to move down, the sample is held in the coring tube 1.

The connection 5 provided between the coring tube 1 and the check valve 6 serves to prevent an inadvertent ingress of soil particles in the check valve 6 at a maximum filling of the coring tube with the bottom soil, thereby precluding formation of a vacuum in the coring tube 1.

When the device is on land the fastening bolts 10 are screwed out, the coring tube 1 is released and then disassembled into the separate sections 3 to obtain the layers in the vertical.

The device according to the invention makes it possible to take samples of bottom sediments in the form of separate layers having the initial unchanged structure under adverse weather conditions, irrespective of the speed of the device sinking to the bottom of a water basin which cannot be insured by devices wherein the sinking in the bottom soil is accomplished by the action of impact.

The invention has been described in detail with particular reference to preferred embodiments thereof, but it will be understood that variations and modifications can be effected within the spirit and scope of the invention.

What is claimed is:

1. A device for taking samples of bottom sediments from water basins, comprising:

a vertical coring tube;

sections of said coring tube arranged in succession one after another longitudinally of said tube;

a closed upper end of said tube;

an open lower end of said tube;

a check valve built in said upper end;

a ballast weight on said upper end;

rod-type vertical supports having upper and lower ends and a length greater than the length of said coring tube and uniformly spaced around the circumference of said coring tube;

at least three hollow cylinders with closed upper and lower ends;

a central hole in each of said upper and lower ends of each of said hollow cylinders;

a plunger in each of said hollow cylinders;

said cylinders installed around said tube, being uniformly spaced and parallel to the tube and secured by the lower ends thereof to the ballast weight, so that said lower ends of the cylinders are on a level approximately the same as that of the upper end of the tube;

each upper end of said rod-type supports passing through a hole in one of said lower ends of the cylinders and being rigidly connected to one of said plungers in one of said cylinders.

2. A device according to claim 1, which includes conical attachments installed on said rod-type supports with the vertices of cones facing the lower ends of said supports, said conical attachments each being in a rest position below said open lower end of said tube when each plunger is adjacent a lower end of its respective cylinder.

3. A device according to claim 1, wherein the ratio of the diameter of said holes in the upper ends of said cylinders to the bore diameter of said cylinders is less than 1:3.

4. A device according to claim 1, wherein said lower ends of said cylinders are connected to said ballast weight by means of carrying elements.

* * * * *

UNITED STATES PATENT AND TRADEMARK OFFICE

CERTIFICATE OF CORRECTION

PATENT NO. : 4,709,584

DATED : December 1, 1987

INVENTOR(S) : Martin A. Voll, et al

It is certified that error appears in the above-identified patent and that said Letters Patent are hereby corrected as shown below:

Figure 2 should read as shown on the attached sheet.

Signed and Sealed this

Sixth Day of September, 1988

*Attest:*

DONALD J. QUIGG

*Attesting Officer*

*Commissioner of Patents and Trademarks*